US006752639B1

(12) United States Patent
Kirkman et al.

(10) Patent No.: US 6,752,639 B1
(45) Date of Patent: Jun. 22, 2004

(54) ELASTOMERIC CONNECTOR ASSEMBLY AND METHOD FOR PRODUCING THE ASSEMBLY

(75) Inventors: Michael Kirkman, Swansea, MA (US); Joseph A. Kiszka, Freehold, NJ (US); Curtis G. Knaub, North Attleboro, MA (US); Vishwa Nath Shukla, North Attleboro, MA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/369,824

(22) Filed: Feb. 20, 2003

(51) Int. Cl.[7] ..... H01R 4/58
(52) U.S. Cl. ..... 439/91
(58) Field of Search ..... 439/91, 66, 591

(56) References Cited

U.S. PATENT DOCUMENTS 4,955,818 A * 9/1990 Strange et al.
5,297,968 A * 3/1994 Johnson et al. ..... 439/91
5,340,318 A * 8/1994 Kunihiro
5,745,346 A * 4/1998 Ogawa et al. ..... 439/91
5,816,838 A * 10/1998 Del Prete et al.
5,820,391 A * 10/1998 Delprete et al.
6,019,609 A * 2/2000 Strange
6,166,615 A * 12/2000 Winslow et al. ..... 439/91
6,549,636 B2 * 4/2003 Fujimoto et al. ..... 439/91

* cited by examiner

*Primary Examiner*—Gary Paumen

(57) ABSTRACT

A connector assembly having a supporting boot and a connector that is retained with the boot and a method for producing the connector assembly. The boot serves as a retention member that includes a through opening sized to receive the connector. The boot includes first and second opposing surfaces. In a preferred embodiment, the opening at the second surface of the boot is sized for an interference fit with the connector. The opening adjacent the first surface of the boot is larger than the opening at the second body surface. The differential sizes of the though hole openings at respective ends of the through-hole provides a flow channel between the connector and the boot. Wells are provided in the first surface of the boot for a binding agent. A liquid binding agent that is injected into the wells flows through the flow channel and securely fixes the connector within the boot.

20 Claims, 3 Drawing Sheets

Fig. 3b
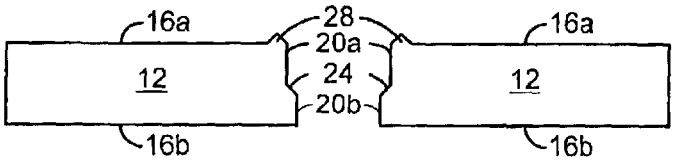
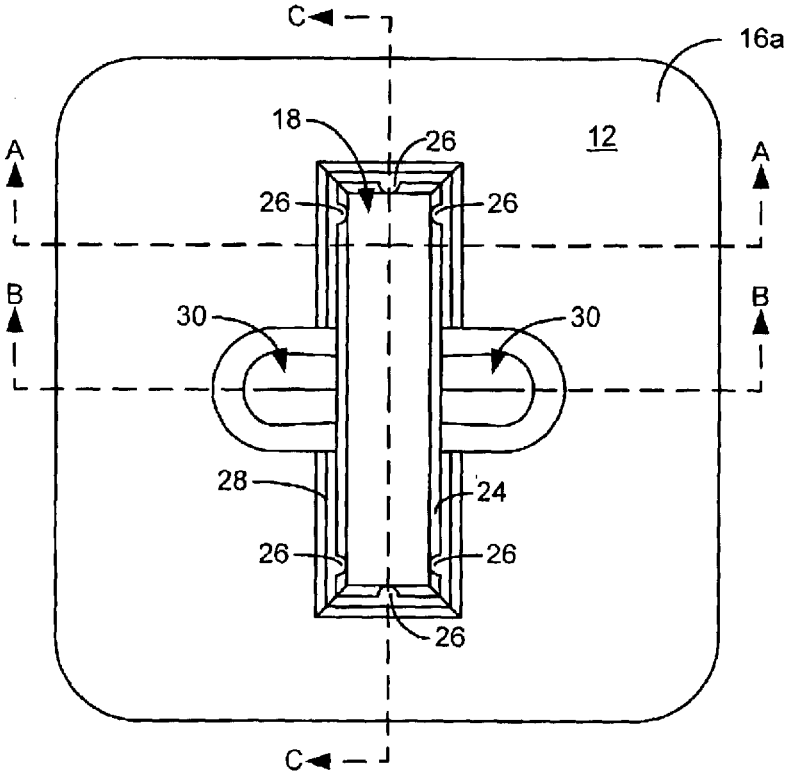
Fig. 3a
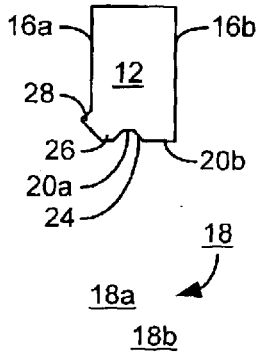
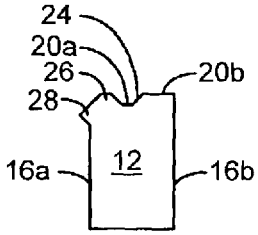
Fig. 3d
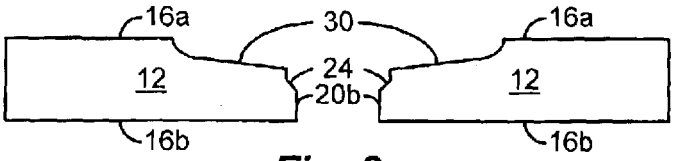
Fig. 3c

ELASTOMERIC CONNECTOR ASSEMBLY AND METHOD FOR PRODUCING THE ASSEMBLY

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates generally to electrical connectors and more specifically, to an interconnecting device suitable for interconnecting circuit boards, a circuit board and an electrical device or two electrical devices.

Connectors are commonly used to interconnect circuit boards or to interconnect a circuit board with an electrical device such as a microphone or other transducer. In some applications, it is advantageous to make an electrical interconnection without soldering or the use of terminals that require a manual or a machine operation to make the desired connections. Known elastomeric connectors allow interconnections to be readily made without soldering or terminals that involve a physical attachment and can provide advantages in the assembly of electronic equipment in many applications.

Elastomeric connectors include elastomeric conductors which are physically retained or arranged in a predetermined pattern which corresponds to a desired contact pattern on a mating circuit board or device. Electrical contacts on a circuit board or device may be plated to improve the conductive contact between circuit board or device and the conductors of the elastomeric connector. The elastomeric connector is aligned between two circuit boards, a circuit board and a device, or any two objects to be electrically interconnected and compressed so that respective conductive members are urged into compressive contact with the respective mating contacts. The compression of the elastomeric conductors against the electrical contact forms an effective conductive connection and avoids complexities and manufacturing costs that are often associated with other types of connectors that require physical connections to be made.

Examples of elastomeric connectors known in the art are shown in U.S. Pat. Nos. 4,955,818; 5,340,318; 5,816,838; 5,820,391 and 6,019,609.

One elastomeric connector assembly known in the art includes an elastomeric connector including alternating conductive and non-conductive members and a supporting boot that is molded around the connector. The molding of the supporting boot around the connective portion is typically accomplished via an insert molding process. In this process, the connector is aligned within a mold and the boot is molded around the connector to form the connector assembly. The final connector assembly may then be mounted in the intended equipment during an equipment assembly process.

It would be desirable to provide a boot for an elastomeric connector that may be first fabricated to allow for the later installation of an elastomeric connector having a predetermined contact pattern. Such a process and boot design requires less complex tooling than is needed to produce an assembly via an insert molding process and advantageously allows large scale assembly operations. Additionally, such a process would permit different connector configurations to be inventoried and employed within a single support frame as needed for particular applications.

BRIEF SUMMARY OF THE INVENTION

In accordance with the present invention, a supporting boot for an elastomeric connector, an elastomeric connector, an elastomeric connector assembly, and a method for producing the same are disclosed. The elastomeric connector includes alternating conductive and non-conductive members. Alternatively, conductive members that extend through an insulative body may be provided in any desired pattern.

The supporting boot or body is molded and has a structure that facilitates the subsequent insertion and mounting of the elastomeric connector in a through-hole provided in the boot. More specifically, the supporting boot has first and second opposing surfaces. The through-hole extends through the boot from the first surface to the second surface. In one embodiment, the through-hole is generally rectangular although the through-hole may have any cross-sectional shape that corresponds to the cross-sectional shape of an associated connector to be mounted within the through-hole of the boot. The through-hole includes first and second through-hole portions adjacent the first and second boot surfaces respectively. The through-hole portion adjacent the second boot surface has a cross-section that is sized to provide an "interference" or "line" fit with tile elastomeric connector when the connector is inserted in installed in the through-hole within the boot. The first through-hole portion has a cross section that is slightly larger than the cross section of the elastomeric connector to provide a channel between the boot surfaces defining the first through-hole portion and the opposing surfaces of the elastomeric connector when the connector is installed in the mounting position in the through-hole of the boot.

A taper is provided between the surfaces of the first and second through-hole portions to serve as a guide and to facilitate the insertion of the connector through the through-hole of the boot. A tapered guide ridge that extends from the first surface of the boot and extends around the through-hole is also provided to serve as a guide for the connector during the installation of the connector into the supporting boot.

Ribs that extend from the surfaces defining the first through-hole portion are provided. The ribs have an outer end that abuts the elastomeric connector when the connector is installed within the boot to assure the alignment of the connector within the boot while not materially obstructing the channel surrounding connector. Recesses are provided in the first surface of the supporting boot on opposing sides of the through-hole. The recesses are communicative with the channel. To permanently secure the elastomeric connector within the supporting boot a binding agent such as an adhesive, glue or other suitable material is introduced into the respective recesses by injection or otherwise. The binding agent has a viscosity that permits the material to flow around the connector through the above referenced channel. Following the curing of the binding agent, the elastomeric connector is permanently secured within the supporting boot.

Other aspects, features and advantages of the invention will be apparent to those of ordinary skill in the art from the Detailed Description of the Invention that follows.

BRIEF DESCRIPTION OF THE SEVERAL VIEWS OF THE DRAWING

The invention will be more fully understood by reference to the following Detailed Description of the Invention in conjunction with the Drawing of which:

FIG. 3*a* is a top plan view of the supporting boot depicted in FIG. 1;

FIG. 3*b* is a side sectional view through Section A—A shown in FIG. 3*a*;

FIG. 3*c* is a side sectional view through Section B—B shown in FIG. 3*a*; and FIG. 3*d* is a side sectional view through Section C—C shown in FIG. 3*a*.

DETAILED DESCRIPTION OF THE INVENTION

In accordance with the present invention an improved connector assembly is provided. The assembly includes a supporting boot and a connector that may be mounted within the boot and permanently secured within the boot using a binding agent.

Figure 1:
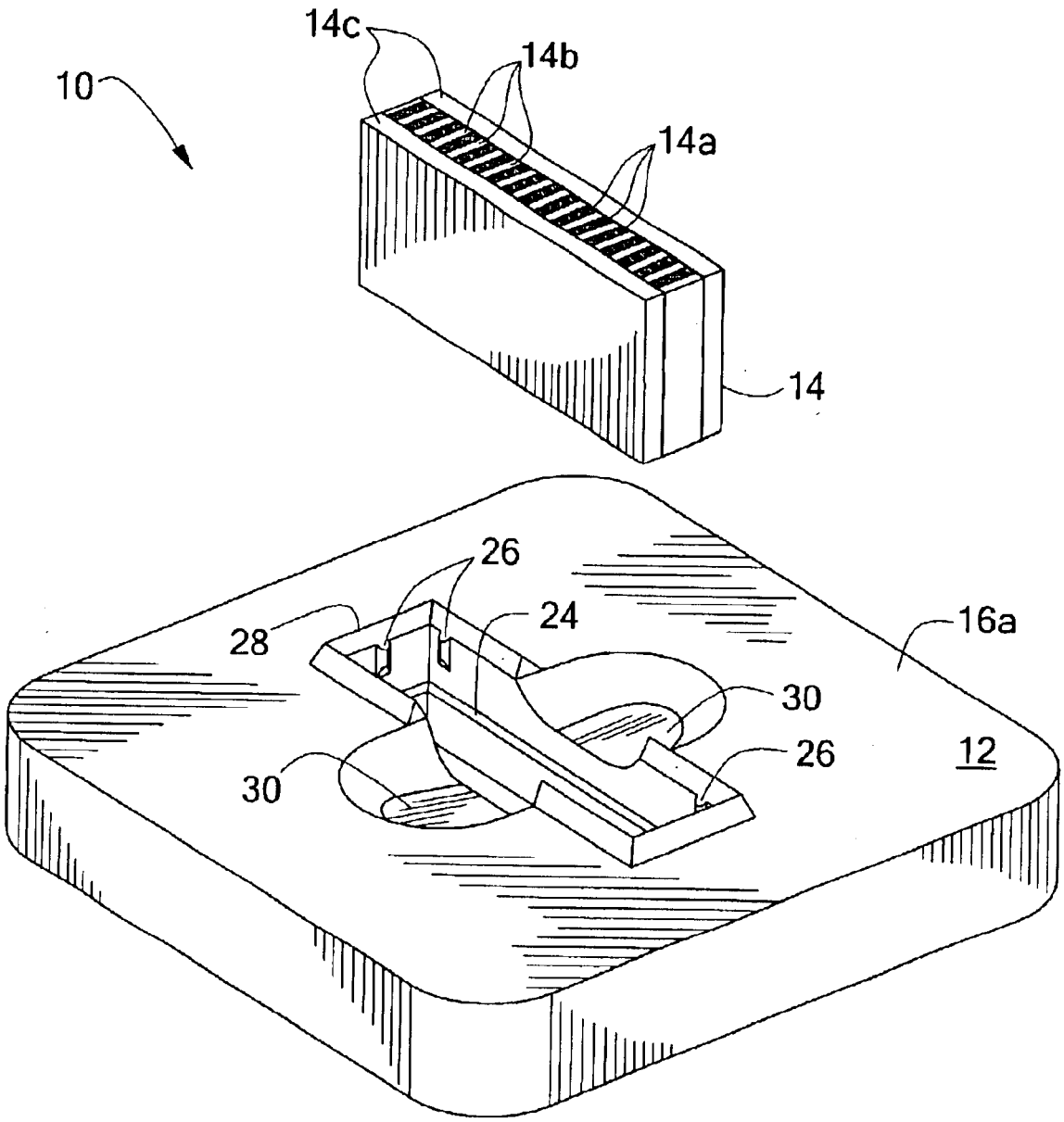
FIG. 1 is an exploded perspective view of an elastomeric connector assembly including an elastomeric connector and a supporting boot in accordance with the present invention.
Figure 2A:
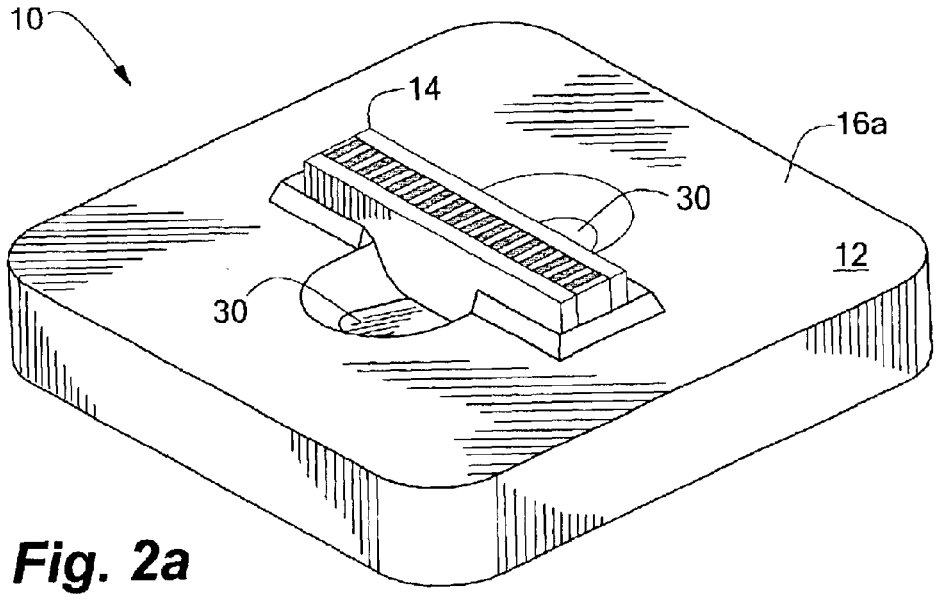
FIG. 2*a* is a top perspective view of the elastomeric connector assembly of FIG. 1 depicting the connector installed within the supporting boot.
Figure 2B:
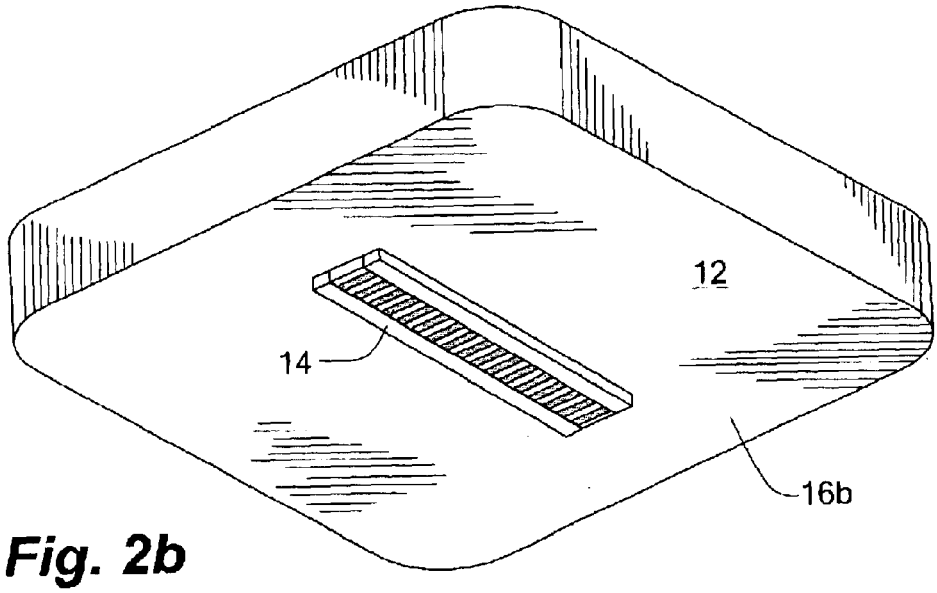
FIG. 2*b* is a bottom perspective view of the elastomeric connector assembly of FIG. 1 depicting the connector installed within the supporting boot.

More specifically, referring to FIGS. 1–3*d*, the assembly 10, includes a supporting boot 12 and a connector 14. The boot 12 is typically molded of a non-conductive elastomeric material such as a silicone rubber or similar elastomer, a thermoplastic, a thermoset plastic or any other suitable material. The connector 12 is depicted in the illustrative embodiment as an elastomeric connector 12. As illustrated, the elastomeric connector 14 includes alternating conductive and non-conductive elastomeric members 14*a*, 14*b* and side insulators 14*c*. The elastomeric conductive members 14*a* may be fabricated in accordance with techniques known in the art and may include suspended silver or carbon particles, gold plated particles or gold plated brass wires. Moreover, any suitable connector that is sized and adapted for use with the boot 12 may be employed. For example, any connector having an insulative body and conductive members extending through the insulative body may be employed. More particularly, the conductive members may comprise elastomeric or metallic members and may be arranged in any desired contact pattern.

The boot 12 has first and second opposing surfaces 16*a*, 16*b* and a through-hole generally designated 18 that extends therebetween. In the illustrative embodiment the through-hole 18 has a generally rectangular cross section to accommodate the connector 14 which also has a generally rectangular cross section. It should be recognized that the cross sections of the through-hole 18 and the connector 18 need not be rectangular.

The through-hole 18 includes first and second through-hole portions 18*a*, 18*b* defined by first and second inner surfaces 20*a*, 20*b* respectively. More specifically, the inner surfaces 20*a* define the first through-hole portion 18*a* adjacent the upper surface 16*a* of the boot 12 and the inner surfaces 20*b* define the second through-hole portion 18*b* adjacent the second surface 16*b* of the boot 12. As will be subsequently discussed, during installation of the connector 14 into the boot 12 the connector 14 is preferably inserted into the through-hole 18 from the first surface 16*a* and urged through the through-hole 18 of the boot 12 until the connector 14 protrudes from the second surface 16*b* of the boot 12. While in the illustrated embodiment, the connector 14 protrudes beyond both surfaces 16*a*, 16*b* of the boot 12, for particular applications it may be desirable for one or both ends of the connector 14 to be flush with the respective surfaces 16*a*, 16*b* of the boot 12 or recessed therefrom in the final mounting position.

The inner surfaces 20*b* define the size of the second through-hole portion 18*b* so as to provide an "interference" or "line" fit with the periphery of the connector 14 when the connector 14 is mounted within the boot 12. The interference fit between the connector 14 and the inner surfaces 20*b* prevents leakage of a liquid binding agent from the top to the bottom of the assembly 10 following the introduction of the liquid binding agent as later discussed. The inner surfaces 20*a* define the size of the first through-hole portion 18*a*. The first through-hole portion 18*a* is slightly larger than the second through-hole portion 18*b* such that the inner surfaces 20*a* are spaced from the side walls 14*c* of the connector 14 by a predetermined spacing to form a flow channel between the side walls 14*c* and the inner surfaces 20*a* of the boot 12 when the connector 14 is mounted within the boot 12. The spacing between the connector side walls 14*c* and the inner surfaces 20*a* is specified to permit a liquid binding agent to flow into the channel surrounding the connector 14 as is subsequently discussed. A spacing or channel width generally between 0.001 and 0.010 inch has been employed with commercially available binding agents although it is recognized that the spacing dimension is a function of the particular adhesive selected, the viscosity of the binding agent employed and the materials being bonded. Accordingly, it is recognized that the channel width may, in certain applications be less than or greater than the above-specified range.

An inclined surface 24 joins the inner surfaces 20*a*, 20*b*. The inclined surface 24 serves to guide the connector 14 into the second portion 18*b* of the through-hole 18 during installation of the connector 14 in the boot 12. In the illustrated embodiment, the inclined surface 24 is angled at approximately 45° although any suitable angle may be employed.

The inner surfaces 20*a* include a plurality or ribs 26 extending from the surfaces 20*a* into the through-hole. In the illustrated embodiment the ends of the ribs 26 are in a plane defined by the inner surfaces 20*b*. As shown, one rib 26 projects from each surface 20*a* at opposing ends of the through-hole 18 and two ribs 26 project from each surface 20*a* on opposing sides of the through-hole 18. The ribs 26 serve to support the connector 14 when installed within the boot 12 and maintain accurate alignment of the connector 14. The number, configuration and spacing of the ribs 26 may vary based upon the specific assembly 10 design. As apparent from FIG. 1 and FIG. 3*d*, in the illustrated embodiment the ribs 26 only extend for a portion of the height of the inner surfaces 20*a* so as not to impede the flow of the binding agent through the flow channel surrounding the connector 14.

A guide ridge 28 extends from the first surface 16*a* of the boot 12 and surrounds the through-hole 18. The guide ridge 28 promotes centering of the connector 14 during the installation of the connector 14 in the through-hole 18 in the boot 12. Recesses 30 are provided on either side of the through-hole 18. The recesses 30 are communicative with the channel formed between the inner surfaces 20*a* and the side walls 14*c* of the connector 14 and serve as wells that receive the liquid binding agent. More specifically, once the connector 14 has been installed in the boot 12 in the final mounting position, a predetermined volume of liquid binding agent is injected or otherwise introduced into each of the recesses 30. The binding agent flows from the respective wells formed by the recesses through the flow channel surrounding the connector 14. The binding agent is cured or allowed to solidify, as applicable, to permanently secure the connector within the boot 12. While the proposed wells are generally semi-circular it should be appreciated that the shapes of the wells may be circular, semicircular or any other suitable shape. Moreover, the wells for dispensing the binding agent may be separated from but communicative with the flow channel or may be provided as a wider trench in the boot surface 16*a* that surrounds the through-hole 18 and is communicative with the flow channel.

The binding agent may comprise any durable and flexible adhesive that is suitable for making a good joint with flexible parts such as a silicone elastomer parts. For example, commercially available air, thermal or UV cured adhesives including Dow Corning(TM) RTV 734, RTV 734 diluted with 25% solvent may be employed. Additionally, Loctite (TM) 5088 and 5092 adhesives may be used.

The boot 12 may be provided with mounting holes, recesses or alignment pins (not shown) for accurately positioning the assembly 10 in a final mounting position within a piece of electronic equipment. Moreover, it will be recognized that the shape of the boot 12 may be varied to accommodate mounting requirements in different applications.

It will further be appreciated by those of ordinary skill in the art that modifications to and variations of the above described supporting boot, connector assembly and method for making the same may be made without departing from the inventive concepts disclosed herein. Accordingly, the invention should not be viewed as limited except by the scope and spirit of the appended claims.

What is claimed is:

1. An electrical connector assembly comprising:

an electrical connector; and a supporting body having first and second opposing body surfaces and a through-hole sized to receive said connector;

said connector mounted in said through-hole in a connector mounting position;

said through-hole having a first through-hole portion defined by first body through-hole walls, said first through-hole portion extending from said first body surface, said through-hole having a second through-hole portion defined by second body through-hole walls, said second through-hole portion extending from said second body surface; and said second through-hole portion sized for an interference fit with said connector, said first body through-hole walls spaced from said connector by a non-zero distance to form a flow channel between said body and said connector at least partially around said connector, said flow channel for receiving a binding agent.

2. The connector assembly of claim 1 further including a plurality of ribs disposed between said first body through-hole walls and said connector to align said connector when said connector is disposed in said connector mounting position.

3. The connector assembly of claim 2 wherein said ribs are integral with said first body through-hole walls and abut said connector when said connector is disposed in said connector mounting position.

4. The connector assembly of claim 3 wherein said first body through-hole walls comprise opposing end walls and opposing side walls and at least one rib extends from each of said end and side walls.

5. The connector assembly of claim 1 further including at least one recess in said first body surface communicative with said flow channel.

6. The connector assembly of claim 1 further including a plurality of recesses in said first body surface communicative with said flow channel.

7. The connector assembly of claim 1 further including a trench formed as a recess in said first body surface and communicative with said flow channel, said trench at least partially surrounding said through-hole.

8. The connector assembly of claim 1 wherein said body includes an inclined surface between said first and second body through-hole walls.

9. The connector assembly of claim 1 further including at least one guide ridge extending from said first body surface and at least partially surrounding said through-hole, said at least one guide ridge having a guide surface inclined downward toward said through-hole so as to guide the connector into said through-hole during installation of said connector into said body.

10. The connector assembly of claim 1 wherein said connector includes a plurality of elastomeric conductors.

11. The connector assembly of claim 1 wherein said connector includes a plurality of alternating generally planar elastomeric conductors and planar elastomer insulators.

12. A retention member for supporting an electrical connector having opposing ends and first and second peripheral sidewall portions adjacent respective ends of said connector, said retention member comprising:

a generally planar body having first and second opposing body surfaces and a through-hole sized to receive said connector; and said through-hole having a first through-hole portion defined by first body through-hole walls, said first through-hole portion extending from said first body surface, said through-hole having a second through-hole portion defined by second body through-hole walls, said second through-hole portion extending from said second body surface;

said second through-hole portion sized for an interference fit with said second sidewall portion of said connector, said first body through-hole walls spaced from said first sidewall portion of said connector to form a flow channel between said body and said connector at least partially around said first sidewall portion for receiving a binding agent; and further including at least one recess in said first body surface communicative with said flow channel when said connector is disposed in said retention member in a connector mounting position.

13. The retention member of claim 12 further including a plurality of ribs extending from said first body through-hole walls, said ribs dimensioned to abut said first sidewall portion of said connector when said connector is disposed in a connector mounting position within said retention member.

14. The retention member of claim 13 wherein said through-hole is generally rectangular and said first body through-hole walls comprise opposing end walls and opposing side walls of said through-hole and at least one rib extends from each of said end and side walls.

15. The retention member of claim 12 further including a plurality of recesses in said first body surface communicative with said flow channel when said connector is disposed in said retention member in a connector mounting position.

16. The retention member of claim 12 further including a trench in said first body surface, said trench communicative with said flow channel when said connector is disposed in said retention member in a connector mounting position, said trench at least partially surrounding said through-hole.

17. The retention member of claim 12 wherein said body includes an inclined surface between said first and second body through-hole walls.

18. The retention member of claim 12 further including at least one guide ridge extending from said first body surface and at least partially surrounding said through-hole, said at least one guide ridge having a guide surface inclined downward toward said through-hole so as to guide the connector into said through-hole during the installation of said connector into said body.

19. A method for producing an electrical connector assembly comprising the steps of:

inserting an electrical connector having sidewalls into a through-hole within a supporting body having first through-hole walls adjacent a first surface of said body and second through-hole walls adjacent a second surface of said body such that said first through-hole walls form an interference fit with said connector sidewalls and said second through-hole walls are spaced from said connector sidewalls at least around a portion of the periphery said connector to form a flow channel around said portion of said periphery; and introducing a binding agent into said flow channel to cause said connector to be permanently secured within said body.

20. The method of claim 19 wherein said flowing step comprises the step of injecting said binding agent into at least one recess formed in the second surface of said body, wherein said recess is communicative with said at least flow channel.

* * * * *